US010763067B1

(12) United States Patent
Watford et al.

(10) Patent No.: US 10,763,067 B1
(45) Date of Patent: Sep. 1, 2020

(54) PANEL WIRE INSTALL INDICATOR OF A RESIDENTIAL CIRCUIT BREAKER

(71) Applicant: Siemens Industry, Inc., Alpharetta, GA (US)

(72) Inventors: Russell Thomas Watford, Lawrenceville, GA (US); Brian Timothy McCoy, Lawrenceville, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 16/553,582

(22) Filed: Aug. 28, 2019

(51) Int. Cl.

| | |
|---|---|
| ***H01R 13/641*** | (2006.01) |
| ***H01H 71/04*** | (2006.01) |
| ***H01R 4/30*** | (2006.01) |
| ***H01H 71/10*** | (2006.01) |

(52) U.S. Cl.
CPC ..... *H01H 71/04* (2013.01); *H01H 71/10* (2013.01); *H01R 4/30* (2013.01); *H01R 13/641* (2013.01)

(58) Field of Classification Search
CPC ..... H01H 71/08; H01H 2001/5861; H01H 2011/0037; H01H 9/0264; H01H 11/0031; H01H 71/0228; H01H 1/2058; H01H 1/5855; H01H 1/5866; H01H 71/0207; H01H 71/0264; H01R 13/641; H01R 13/64; H01R 13/629; H01R 13/74; H01R 4/36; H01R 4/307; H01R 4/34; H01R 11/12; H01R 43/00; H01R 4/26; H01R 4/304; H01R 4/305; H01R 4/363; H01R 4/646; H01R 9/24; H01R 9/2625; H01R 9/2633
See application file for complete search history.

(56) References Cited

U.S. PATENT DOCUMENTS

| | | | | |
|---|---|---|---|---|
| 2009/0242366 | A1* | 10/2009 | Simmons | H01H 71/08 200/293 |
| 2013/0252486 | A1* | 9/2013 | Kosyanchuk | H01R 4/304 439/813 |
| 2015/0031247 | A1* | 1/2015 | McKibben | H01R 13/645 439/681 |
| 2016/0308304 | A1* | 10/2016 | Miller | H01R 13/6277 |
| 2017/0040716 | A1* | 2/2017 | Paolozzi | H01R 4/4836 |

* cited by examiner

*Primary Examiner* — Ahmed M Saeed

(57) ABSTRACT

A residential circuit breaker is provided with means for showing proper installation of a panel wire to ensure that an installer/a contractor is aware that the panel wire has been fully inserted into a circuit breaker lug. The residential circuit breaker comprises a circuit breaker lug having a lug body and a lug body screw. The residential circuit breaker further comprises a panel wire install indicator to indicate proper insertion of a panel wire in the lug body by providing a visual indication to an installer/contractor that the panel wire has been fully inserted in the circuit breaker lug during and after installation. The panel wire install indicator includes a panel wire indicator lever wherein the panel wire indicator lever can indicate if the panel wire has been installed properly and wherein there is a visual indication if the panel wire is no longer present in the lug body.

20 Claims, 8 Drawing Sheets

PANEL WIRE INSTALL INDICATOR OF A RESIDENTIAL CIRCUIT BREAKER

BACKGROUND

1. Field

Aspects of the present invention generally relate to a panel wire install indicator of a Residential Circuit Breaker.

2. Description of the Related Art

A typical arc fault circuit interrupter (AFCI)/ground fault circuit interrupter (GFCI) residential circuit breaker includes a mechanical and an electronic pole. A panel wire is to be inserted into a circuit breaker lug of a residential circuit breaker. However, the concern is if the panel wire is not fully inserted or only partially inserted into the circuit breaker lug. First, the installer/contractor may not fully insert the stripped end of the panel wire into a load lug during installation. The breakers are typically mounted horizontally and how much of the stripped end of the wire is inserted into the lug is unknown when the lug screw is tightened. Second, if the panel wire is not fully inserted in the lug, a lug screw could loosen over time and the panel wire could back out and just be touching the lug or the lug screw. While it may seem that the panel wire has been inserted into the load lug, this is unclear as there is no indicator for installer/contractor that the panel wire is fully inserted into a lug body.

Typical residential circuit breaker includes a load and/or a neutral lug with a lug screw. The circuit breaker lug(s) are designed to accept the panel wires and a lug body screw is provided to secure the connection between the panel wire and the circuit breaker lug.

The existing Residential Circuit breaker designs have several areas of concern. The assumption is that the installer/contractor will insert the panel wire fully into the lug body before tightening the lug body screw thus securing the connection. However, this may not be the case as the installer/contractor may not be aware if the panel wire is fully inserted or is only partially inserted into the lug body. The installer/contractor could install the panel wire but not fully insert it in the lug and tighten the lug screw. In this case, the tip of the panel wire that is stripped could be touching the lug body or screw providing temporary power and could result in an arcing connection, a thermal overload condition or a loss of power. In all three cases, a breaker handle could indicate On and/or Trip position.

Therefore, there is a need for a simplified means to show proper installation of a panel wire within a Residential Circuit Breaker.

SUMMARY

Briefly described, aspects of the present invention relate to circuit breakers. Means for showing proper installation of a panel wire are provided to ensure that an installer/a contractor is aware that the panel wire has been fully inserted into a circuit breaker lug. This is accomplished by incorporating a panel wire insertion lever within a Residential Circuit Breaker. Therefore, reducing the risk of unwanted arcing at the lug area, a thermal overload or a loss of power conditions. The above discussed, advantages and details of this invention below will be appreciated and understood by those skilled in the art from the following detailed description and drawings.

In accordance with one illustrative embodiment of the present invention, a residential circuit breaker is provided. It comprises a circuit breaker lug having a lug body and a lug body screw. The residential circuit breaker further comprises a panel wire install indicator to indicate proper insertion of a panel wire in the lug body by providing a visual indication to an installer/contractor that the panel wire has been fully inserted in the circuit breaker lug during and after installation. The panel wire install indicator includes a panel wire indicator lever wherein the panel wire indicator lever is capable of indicating if the panel wire has been installed properly and wherein there is a visual indication if the panel wire is no longer present in the lug body.

In accordance with one illustrative embodiment of the present invention, a residential circuit breaker is provided. It comprises a left pole mechanical module, a right pole mechanical module and a first circuit breaker lug having a first lug body and a first lug body screw. The residential circuit breaker further comprises a first panel wire install indicator to indicate proper insertion of a panel wire in the first lug body by providing a visual indication to an installer/contractor that the panel wire has been fully inserted in the first circuit breaker lug during and after installation. The first panel wire install indicator includes a first panel wire indicator lever wherein the first panel wire indicator lever is capable of indicating if the panel wire has been installed properly and wherein there is a visual indication if the panel wire is no longer present in the first lug body. The first panel wire install indicator further includes a first compression spring that is located in the left pole mechanical module and a second panel wire install indicator further including a second compression spring that is located in the right pole mechanical module.

In accordance with another illustrative embodiment of the present invention, a method of providing an install indicator of a panel wire in a residential circuit breaker. The method comprises providing a circuit breaker lug having a lug body and a lug body screw. The method further comprises providing a panel wire install indicator to indicate proper insertion of the panel wire in the lug body by providing a visual indication to an installer/contractor that the panel wire has been fully inserted in the circuit breaker lug during and after installation. The panel wire install indicator includes a panel wire indicator lever wherein the panel wire indicator lever is capable of indicating if the panel wire has been installed properly and wherein there is a visual indication if the panel wire is no longer present in the lug body.

DETAILED DESCRIPTION

Figure 1:
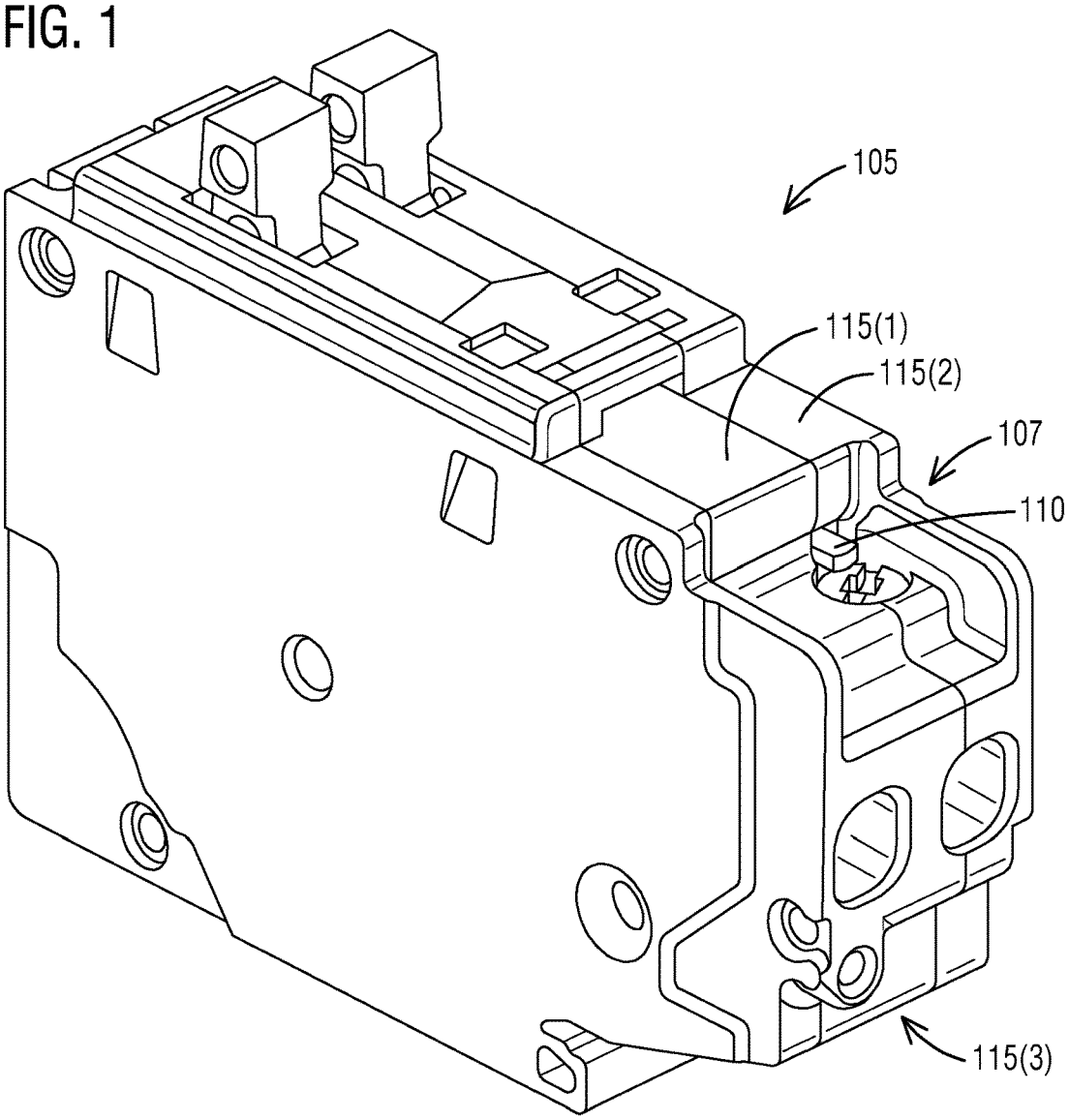
FIG. 1 illustrates a perspective view of a residential circuit breaker (RCB) with a panel wire install indicator that includes a panel wire indicator lever to provide an indication about status of a panel wire in a lug body of a circuit breaker lug in accordance with an exemplary embodiment of the present invention.

To facilitate an understanding of embodiments, principles, and features of the present invention, they are explained hereinafter with reference to implementation in illustrative embodiments. In particular, they are described in the context of an ability to provide a panel wire indicator lever near the lug area to ensure that a panel wire has been fully inserted into a circuit breaker lug. This is accomplished by implementing a pivoting lever that over hangs a lug body screw head. The top of the lever could include a bright colored surface to provide an easy visual contrast to the surrounding plastic. The purpose of this lever is to restrict the ability of inserting a tool to tighten the lug screw. Also, to provide an easy visual indication that the lug screw does not have a panel wire installed. When the panel wire is fully inserted in the lug body, the lever is rotated to provide full access to the lug screw head. After the lug screw is torqued, the lever will remain in position indicating that the panel wire is fully inserted and secure. If the panel wire is not fully inserted but the lug screw is tightened, a panel wire install indicator will return to its original position and overhang a portion of the lug screw head when the tool is removed. Therefore, indicating that the panel wire is not properly inserted in the lug body and is not secured. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

These and other embodiments of the Residential Circuit Breaker with a panel wire install indicator according to the present disclosure are described below with reference to FIGS. 1-14 herein. Like reference numerals used in the drawings identify similar or identical elements throughout the several views. The drawings are not necessarily drawn to scale.

Consistent with one embodiment of the present invention, FIG. 1 represents a perspective view of a residential circuit breaker (RCB) 105 in accordance with an exemplary embodiment of the present invention. FIG. 1 is an isometric view of a two-pole electronic circuit breaker including a means to indicate proper panel wire insertion in a lug body in accordance with this invention. In particular, the residential circuit breaker (RCB) 105 includes a panel wire install indicator 107 including a panel wire indicator lever 110. The panel wire indicator lever 110 to provide an indication about status of a panel wire (not shown) in a lug body (not seen) of a circuit breaker lug of the residential circuit breaker 105. The panel wire indicator lever 110 ensures that an installer/a contractor is aware that the panel wire has been fully inserted into the circuit breaker lug.

The residential circuit breaker 105 may be a two-pole electronic circuit breaker that consists of 3 modules—a left pole mechanical module 115(1), a right pole mechanical module 115(2) and an electronic module 115(3). Modules 115(1) and 115(2) include typical mechanism components that will close a moveable arm and a contact when a breaker handle is rotated clockwise to a fully ON position. Modules (115(1) and 115(2)) include a moveable arm and a contact, a stationary terminal and contacts, cradles, breaker handles, springs, armatures, bimetals, flexible copper braids, bases, and covers. These are typical mechanical components of a residential circuit breaker. The residential circuit breaker 105 includes the panel wire indicator lever 110 and a compression spring that are located in modules (115(1) and 115(2)) and are located toward a load lug assembly including the circuit breaker lug of the residential circuit breaker 105.

The panel wire indicator lever 110 covers a portion of a lug body screw located in modules 115(1) and 115(2). The panel wire indicator lever 110 can be made of a thermoplastic glass filled Nylon 6/6 material such as BASF A3EG6 or a mineral filled Phenolic material, for example, Durez 152.

Figure 2:
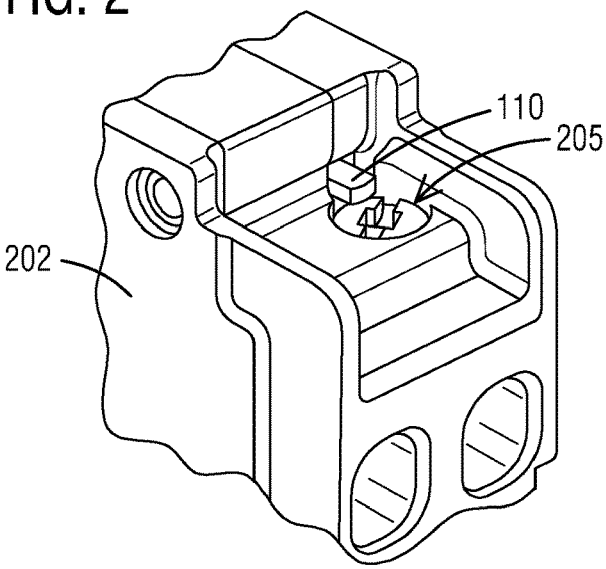
FIG. 2 illustrates a zoomed-in view of a portion of the residential circuit breaker (RCB) of FIG. 1 in accordance with an exemplary embodiment of the present invention.

Referring to FIG. 2, it illustrates a zoomed-in view of a portion 202 of the residential circuit breaker (RCB) 105 of FIG. 1 in accordance with an exemplary embodiment of the present invention. The purpose of the panel wire indicator lever 110 is to restrict that ability of inserting a tool to tighten a lug screw (not seen). Also, to provide an easy visual indication that the lug screw does not have a panel wire installed. When the panel wire is fully inserted in the lug body, the panel wire indicator lever 110 is rotated to provide fully access to a lug screw head 205. After the lug screw is torqued, the panel wire indicator lever 110 will remain in position indicating that the panel wire is fully inserted and secure. If the panel wire is not fully inserted but the lug screw is tightened, the panel wire indicator lever 110 will return to its original position and overhang a portion of the lug screw head 205 when the tool is removed. Therefore, indicating that the panel wire is not properly inserted in the lug body and is not secured.

Figure 3:
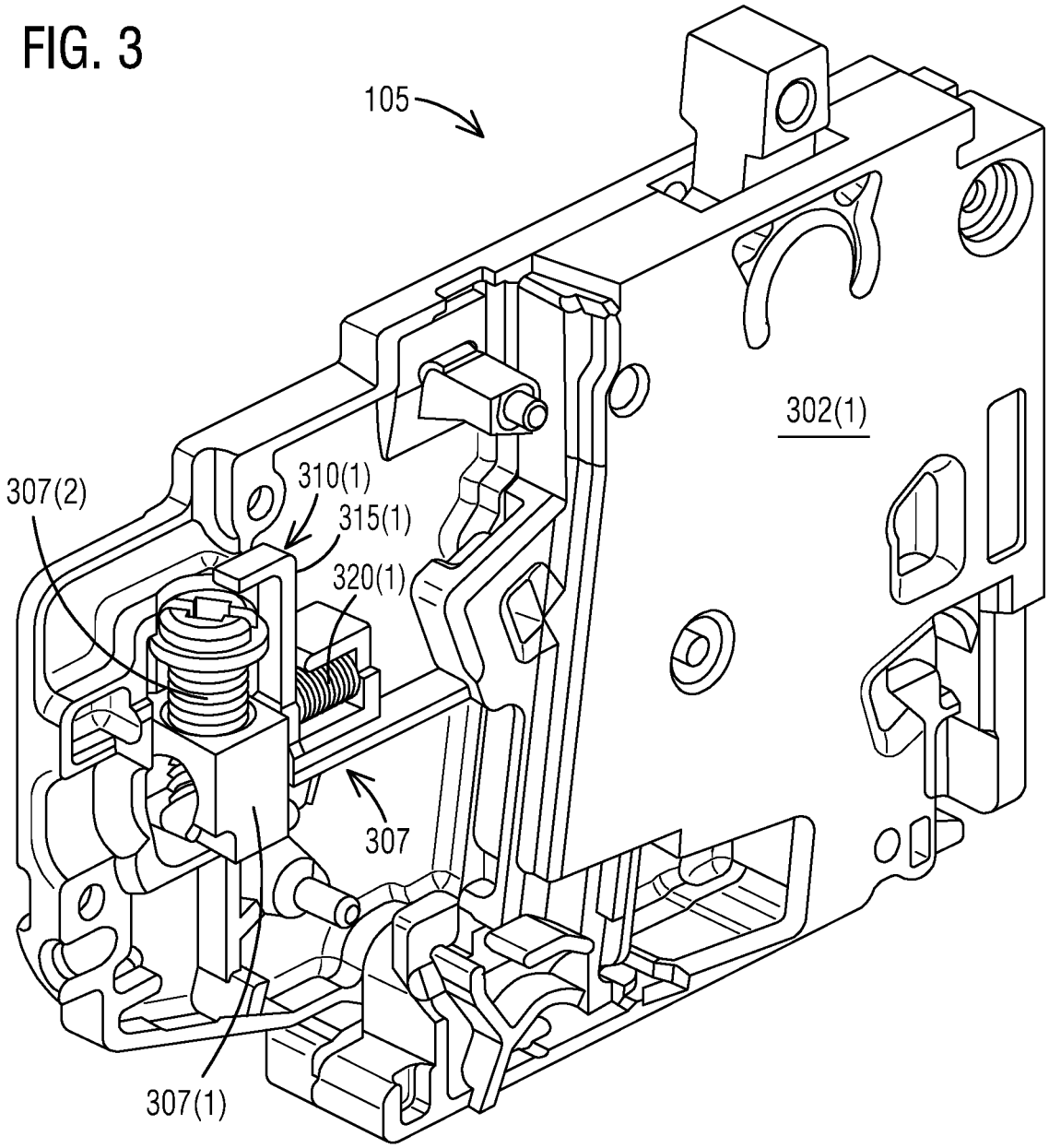
FIG. 3 illustrates a perspective view of a left pole mechanical module of the residential circuit breaker (RCB) of FIG. 1 in accordance with an exemplary embodiment of the present invention.

Turning now to FIG. 3, it illustrates a perspective view of a left pole mechanical module 302(1) of the residential circuit breaker (RCB) 105 of FIG. 1 in accordance with an exemplary embodiment of the present invention. The residential circuit breaker 105 further comprises a load lug assembly, a right pole mechanical module 302(2) (see FIG. 4) and the electronic module 115(3) (see FIG. 1).

The left pole mechanical module 302(1) of the residential circuit breaker (RCB) 105 comprises a circuit breaker lug 307 having a lug body 307(1) and a lug body screw 307(2). The left pole mechanical module 302(1) of the residential circuit breaker (RCB) 105 further comprises a first panel wire install indicator 310(1) to indicate proper insertion of a panel wire (not shown) in the lug body 307(1) by providing a visual indication to an installer/contractor that the panel wire has been fully inserted in the circuit breaker lug 307 during and after installation.

The first panel wire install indicator 310(1) includes a first panel wire indicator lever 315(1) that is capable of indicating if the panel wire has been installed properly and there is a visual indication if the panel wire is no longer present in the lug body 307(1). The first panel wire install indicator 310(1) further includes a first compression spring 320(1) that is located in the left pole mechanical module 302(1) such that the first compression spring 320(1) is located towards the load lug assembly.

The first panel wire indicator lever 315(1) covers a portion of the lug body screw 307(2) located in the left pole mechanical module 302(1). The first panel wire indicator lever 315(1) may be made of either a thermoplastic glass filled Nylon 6/6 material or a mineral filled Phenolic material.

Figure 4:
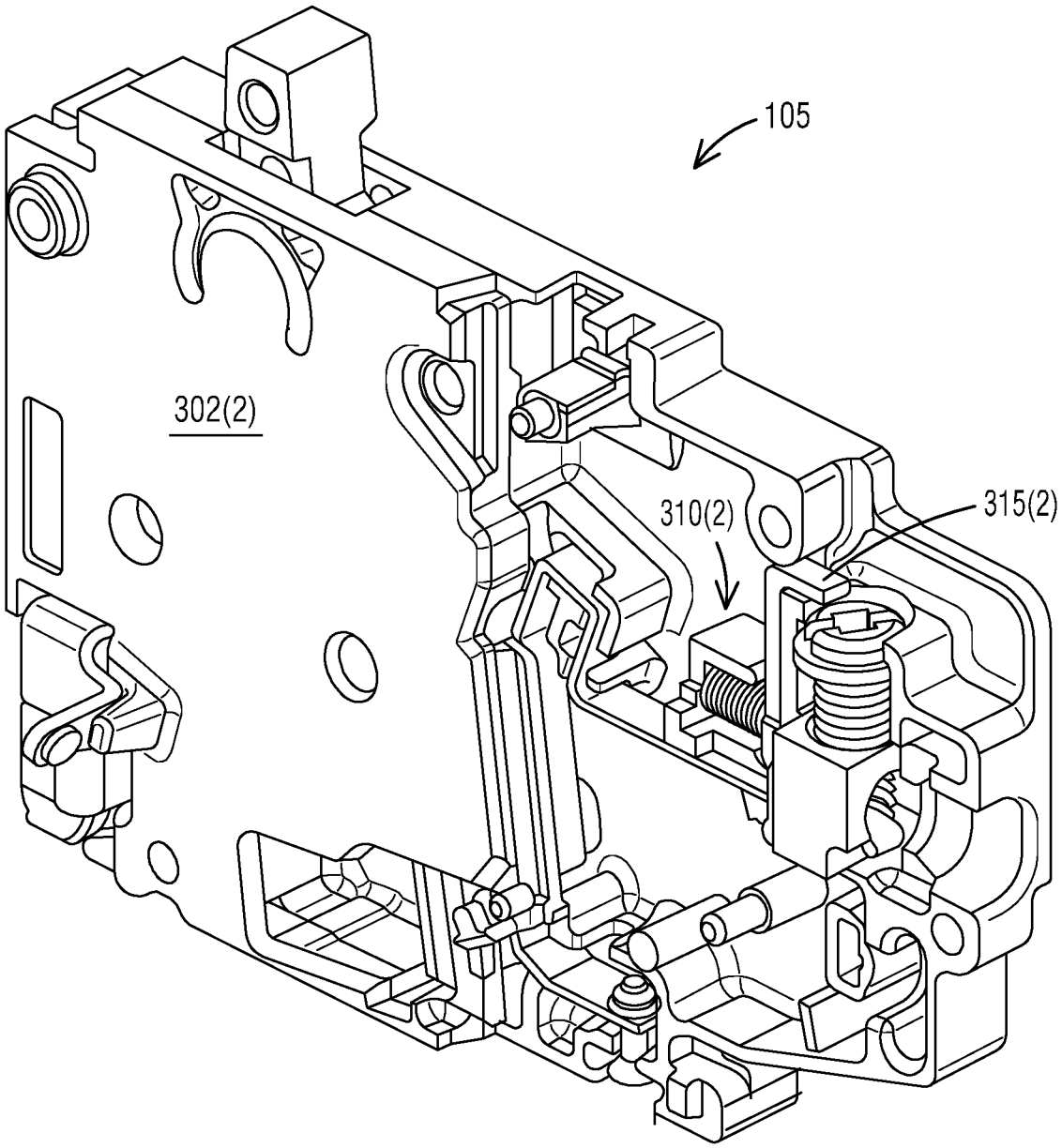
FIG. 4 illustrates a perspective view of a right pole mechanical module of the residential circuit breaker (RCB) of FIG. 1 in accordance with an exemplary embodiment of the present invention.

FIG. 4 illustrates a perspective view of a right pole mechanical module 302(2) of the residential circuit breaker (RCB) 105 of FIG. 1 in accordance with an exemplary embodiment of the present invention. The right pole mechanical module 302(2) of the residential circuit breaker 105 comprises a second panel wire install indicator 310(2). The second panel wire install indicator 310(2) further includes a second compression spring 320(2) that is located in the right pole mechanical module 302(2) such that the second compression spring 320(2) is located towards the load lug assembly. The second panel wire install indicator 310(2) includes a second panel wire indicator lever 315(2).

Figure 5:
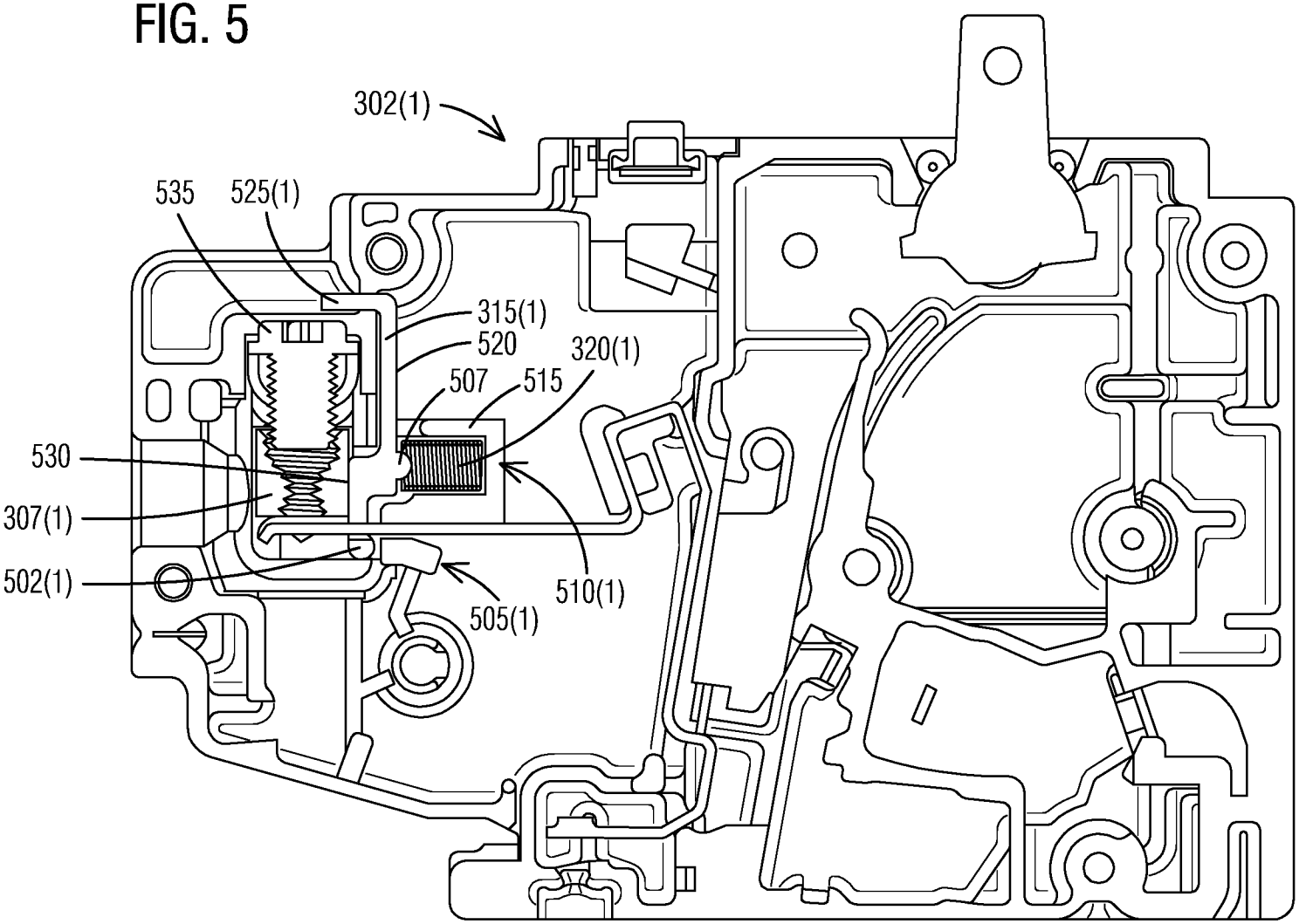
FIG. 5 illustrates a front view of the left pole mechanical module of the residential circuit breaker (RCB) of FIG. 3 in accordance with an exemplary embodiment of the present invention.

As seen in FIG. 5, it illustrates a front view of the left pole mechanical module 302(1) of the residential circuit breaker (RCB) 105 of FIG. 3 in accordance with an exemplary embodiment of the present invention. The first panel wire indicator lever 315(1) includes a first post 502(1) that pivots within a first pocket 505(1) located in the left pole mechanical module 302(1). The first panel wire indicator lever 315(1) includes a post 507 to locate the first compression spring 320(1) such that the first compression spring 320(1) is configured to force the first panel wire indicator lever 315(1) to rotate in a clockwise direction when the panel wire is not installed in the lug body 307(1).

A first end of the first compression spring 320(1) rests against a solid stop feature 510(1) located in the left pole mechanical module 302(1) such that the first compression spring 320(1) is captured in the left pole mechanical module 302(1) with a surrounding geometry 515 on up to two sides, wherein the surrounding geometry 515 in the left pole mechanical module 302(1) provides a guide as the first compression spring 320(1) is extended and compressed during the panel wire insertion and/or removal from the lug body 307(1). An opposite end being a second end of the first compression spring 320(1) pushes against a panel wire indicator lever surface 520.

The first panel wire indicator lever 315(1) includes a colored surface 525(1) that is used to indicate that the panel wire has been installed properly. The first panel wire indicator lever 315(1) is configured to rotate clockwise by pushing the panel wire against a wire indicator lever surface 530 such that as the first panel wire indicator lever 315(1) rotates clockwise and a lug body screw surface 535 of the lug body screw 307(1) is fully exposed to insert a tool for tightening a connection. The first compression spring 320(1) compresses during this operation and the first compression spring 320(1) provides a force and a travel in an extended position to ensure that the colored surface 525 overhangs a portion of the lug body screw surface 535 when the panel wire is not installed.

Figure 6:
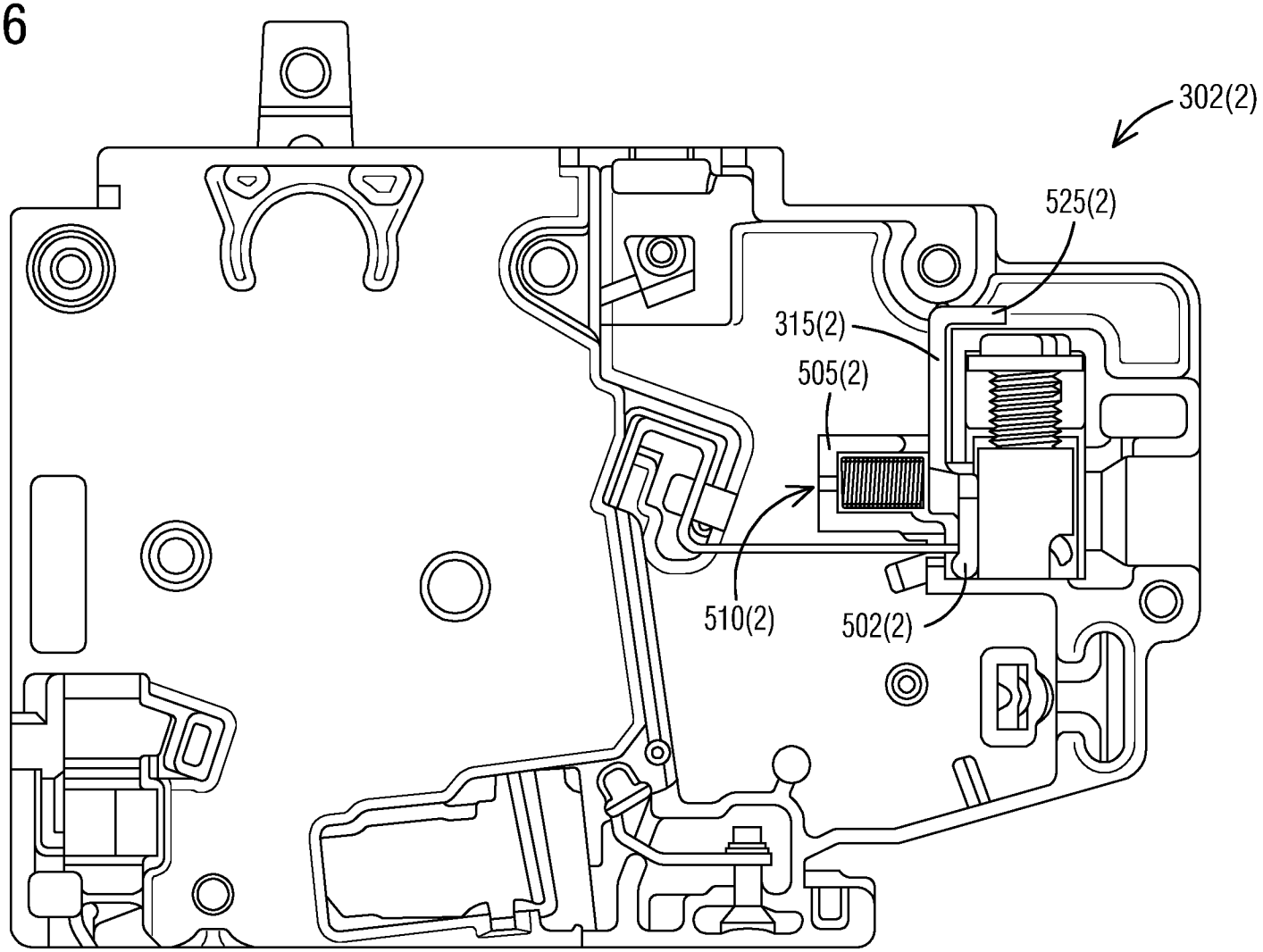
FIG. 6 illustrates a front view of the right pole mechanical module of the residential circuit breaker (RCB) of FIG. 4 in accordance with an exemplary embodiment of the present invention.

As shown in FIG. 6, it illustrates a front view of the right pole mechanical module 302(2) of the residential circuit breaker (RCB) 105 of FIG. 4 in accordance with an exemplary embodiment of the present invention. The second panel wire indicator lever 315(2) includes a second post 502(2) that pivots within a second pocket 505(2) located in the right pole mechanical module 302(2). A first end of the second compression spring 320(2) rests against a solid stop feature 510(2) located in the right pole mechanical module 302(2). The second panel wire indicator lever 315(2) includes a colored surface 525(2) to indicate that the panel wire has been installed properly.

Figure 7:
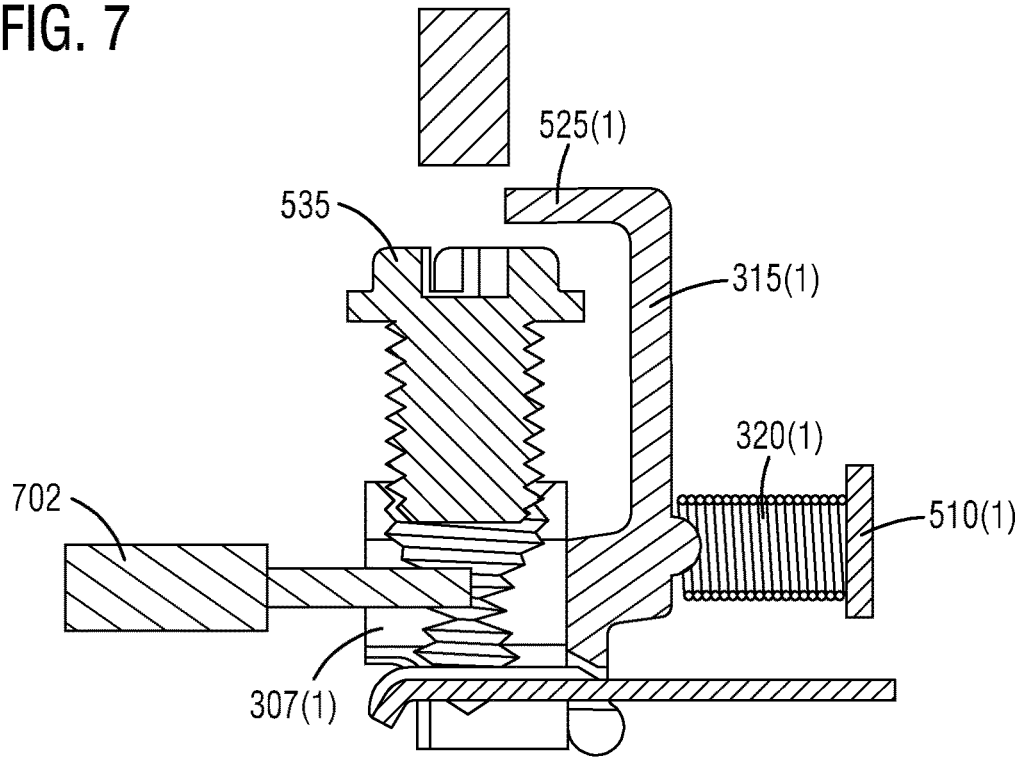
FIG. 7 illustrates a schematic view of a panel wire not fully inserted into a lug body in accordance with an exemplary embodiment of the present invention.

In FIG. 7, it illustrates a schematic view of a panel wire 702 not fully inserted into the lug body 307(1) in accordance with an exemplary embodiment of the present invention. The first end of the first compression spring 320(1) rests against the solid stop feature 510(1) located in the left pole mechanical module 302(1). This first compression spring 320(1) forces the first panel wire indicator lever 315(1) to rotate in a clockwise direction when the panel wire 702 is not installed in the lug body 307(1). The other end of the first compression spring 320(1) rests against the solid stop feature 510(1). The first panel wire indicator lever 315(1) includes the colored surface 525(1) that is used to indicate that the panel wire 702 has been installed properly. The color of this surface is chosen so that it contrasts with the surrounding plastic.

Figure 8:
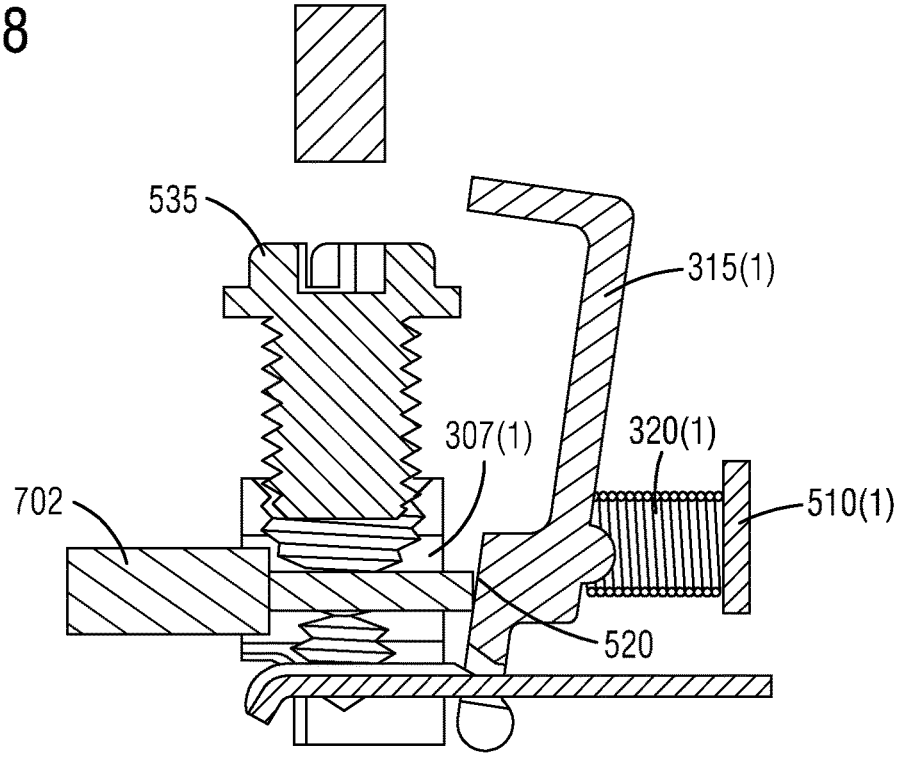
FIG. 8 illustrates a schematic view of a panel wire fully inserted into a lug body in accordance with an exemplary embodiment of the present invention.

With regards to FIG. 8, it illustrates a schematic view of the panel wire 702 fully inserted into the lug body 307(1) in accordance with an exemplary embodiment of the present invention. The first panel wire indicator lever 315(1) is rotated clockwise by pushing the panel wire 702 against the wire indicator lever surface 520. The first panel wire indicator lever 315(1) rotates clockwise and the lug body screw surface 535 is fully exposed to insert a tool for tightening the connection.

Figure 9:
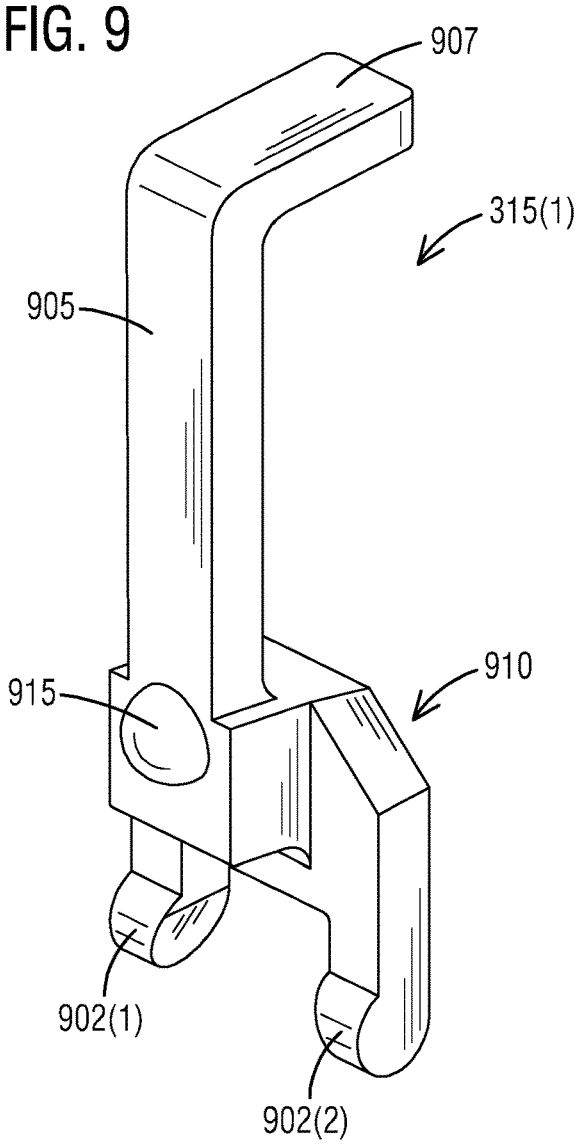
FIG. 9 illustrates a perspective view of a panel wire indicator lever in accordance with an exemplary embodiment of the present invention.

With respect to FIG. 9, it illustrates a perspective view of the first panel wire indicator lever 315(1) in accordance with an exemplary embodiment of the present invention. The first panel wire indicator lever 315(1) includes a pair of posts 902(1-2), The opposite end of the first compression spring 320(1) pushes against a panel wire-indicator lever surface 905. The first compression spring 320(1) may be made of music wire or stainless steel. The first panel wire indicator lever 315(1) includes a colored surface 907 that is used to indicate that the panel wire 702 has been installed properly. The color of this surface is chosen so that it contrasts with the surrounding plastic. The first panel wire indicator lever 315(1) is rotated clockwise by pushing the panel wire 702 against a wire indicator lever surface 910. The first panel wire indicator lever 315(1) includes a post 915 such that it presses against the first compression spring 320(1).

In operation, the first panel wire indicator lever 315(1) rotates clockwise and a lug body screw surface is fully exposed to insert a tool for tightening the connection. The first compression spring 320(1) compresses during this operation. The first compression spring 320(1) provides a force of 0.33±30% pounds and travel 0.06±0.01 inch in the extended position to ensure that the colored surface 907 overhangs a portion of a lug body screw when the panel wire 702 is not installed.

Figure 11:
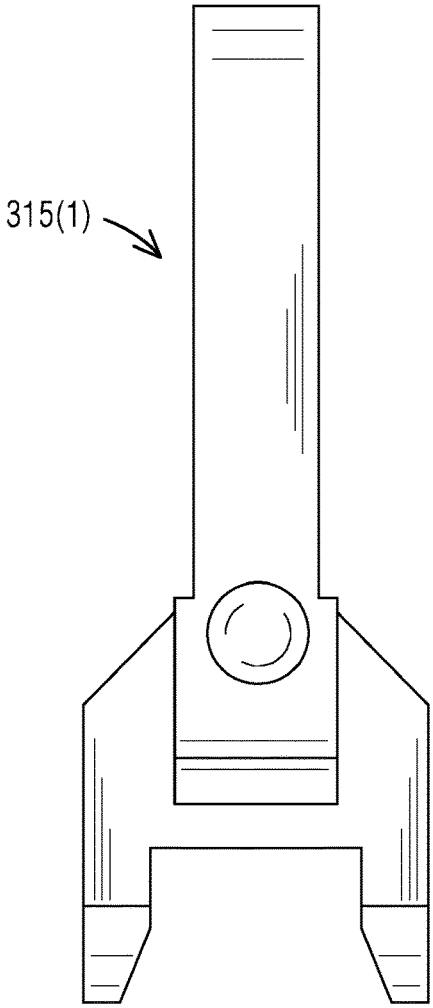
FIG. 11 illustrates a front view of the panel wire indicator lever of FIG. 9 in accordance with an exemplary embodiment of the present invention.
Figure 10:
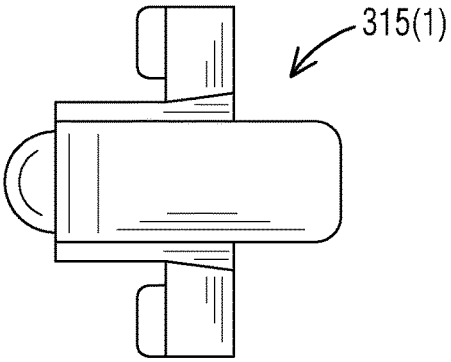
FIG. 10 illustrates a top view of the panel wire indicator lever of FIG. 9 in accordance with an exemplary embodiment of the present invention.
Figure 12:
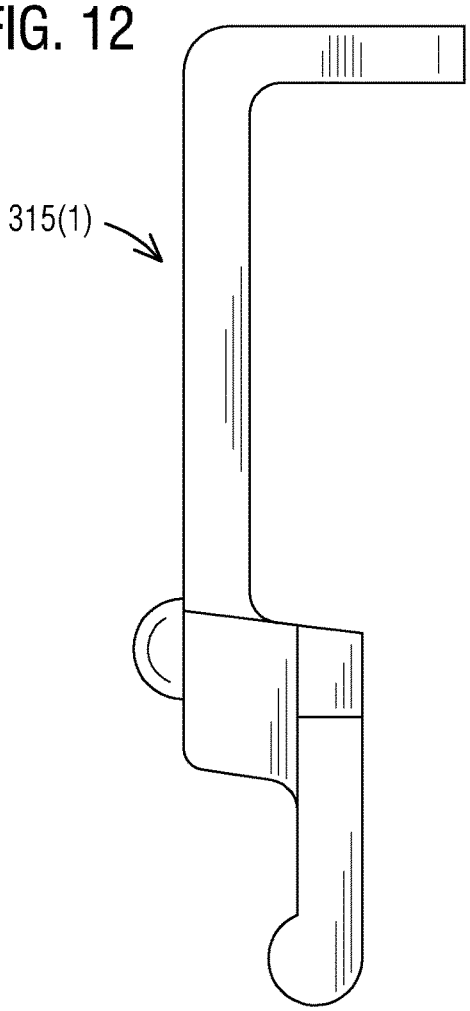
FIG. 12 illustrates a side view of the panel wire indicator lever of FIG. 9 in accordance with an exemplary embodiment of the present invention.
Figure 13:
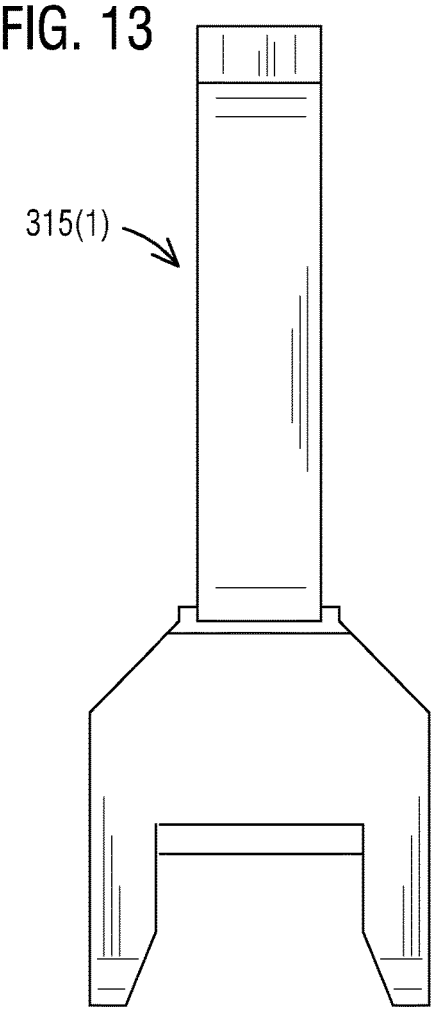
FIG. 13 illustrates a back view of the panel wire indicator lever of FIG. 9 in accordance with an exemplary embodiment of the present invention.

FIG. 10 illustrates a top view of the first panel wire indicator lever 315(1) of FIG. 9 in accordance with an exemplary embodiment of the present invention. FIG. 11 illustrates a front view of the first panel wire indicator lever 315(1) of FIG. 9 in accordance with an exemplary embodiment of the present invention. FIG. 12 illustrates a side view of the first panel wire indicator lever 315(1) of FIG. 9 in accordance with an exemplary embodiment of the present invention. FIG. 13 illustrates a back view of the first panel wire indicator lever 315(1) of FIG. 9 in accordance with an exemplary embodiment of the present invention.

Figure 14:
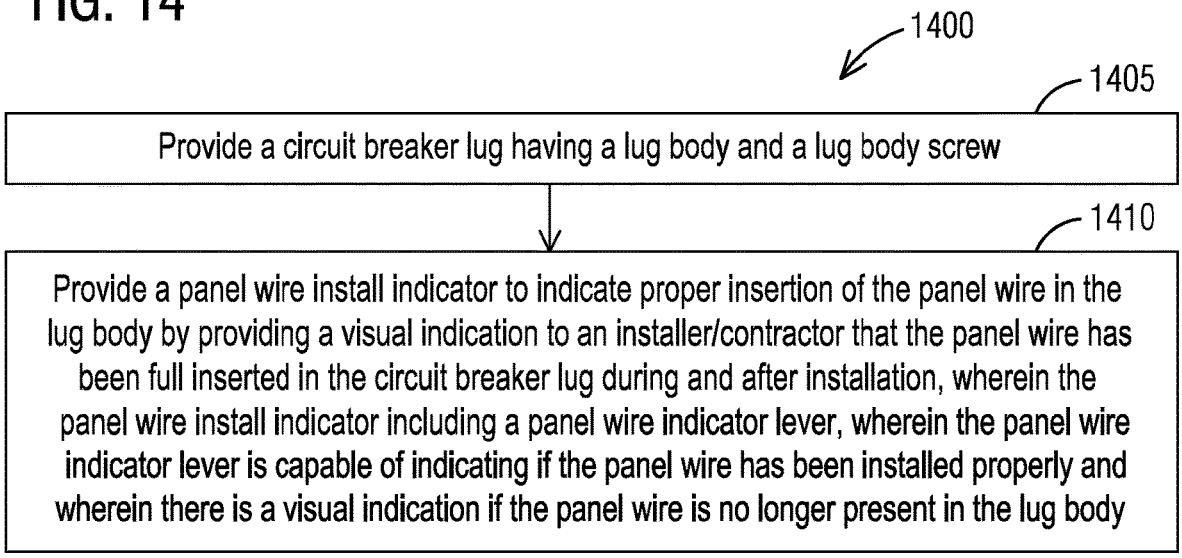
FIG. 14 illustrates a schematic view of a flow chart of a method of providing an install indicator of a panel wire in a residential circuit breaker in accordance with an exemplary embodiment of the present invention.

FIG. 14 illustrates a schematic view of a flow chart of a method 1400 of providing an install indicator of a panel wire in a residential circuit breaker in accordance with an exemplary embodiment of the present invention. Reference is made to the elements and features described in FIGS. 1-13. It should be appreciated that some steps are not required to be performed in any particular order, and that some steps are optional.

For providing an install indicator of the panel wire 702 in the residential circuit breaker 105, the method 1400 in step 1405 provides a circuit breaker lug having a lug body and a lug body screw. The method 1400 further includes a step 1410 of providing a panel wire install indicator to indicate proper insertion of the panel wire in the lug body by providing a visual indication to an installer/contractor that the panel wire has been fully inserted in the circuit breaker lug during and after installation. The panel wire install indicator includes the first panel wire indicator lever 315(1) of FIG. 9. The first panel wire indicator lever 315(1) is capable of indicating if the panel wire 702 has been installed properly and wherein there is a visual indication if the panel wire 702 is no longer present in the lug body.

While a residential circuit breaker is described here a range of one or more other circuit breaker means or other forms of circuit breakers are also contemplated by the present invention. For example, other types of circuit breakers may be implemented based on one or more features presented above without deviating from the spirit of the present invention.

The techniques described herein can be particularly useful for the arc fault circuit interrupter (AFCI)/the ground-fault circuit interrupter (GFCI) indication. While particular embodiments are described in terms of an arc fault circuit interrupter (AFCI)/a ground-fault circuit interrupter (GFCI) indication, the techniques described herein are not limited to such a structure but can also be used with other electrical structures or configurations.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A residential circuit breaker comprising:

a circuit breaker lug having a lug body and a lug body screw; and a panel wire install indicator to indicate proper insertion of a panel wire in the lug body by providing a visual indication to an installer/contractor that the panel wire has been fully inserted in the circuit breaker lug during and after installation, wherein the panel wire install indicator including a panel wire indicator lever wherein the panel wire indicator lever is capable of indicating if the panel wire has been installed properly and wherein there is a visual indication if the panel wire is no longer present in the lug body.

2. The residential circuit breaker of claim 1, further comprising:

a load lug assembly;

a left pole mechanical module;

a right pole mechanical module; and an electronic module, wherein the panel wire install indicator further including a first compression spring that is located in the left pole mechanical module and a second compression spring that is located in the right pole mechanical module such that the first compression spring and the second compression spring are located toward the load lug assembly.

3. The residential circuit breaker of claim 1, wherein the panel wire indicator lever covers a portion of the lug body screw located in the left pole mechanical module.

4. The residential circuit breaker of claim 1, wherein the panel wire indicator lever is made of either a thermoplastic glass filled Nylon 6/6 material or a mineral filled Phenolic material.

5. The residential circuit breaker of claim 1, wherein the panel wire indicator lever includes a first post that pivots within a first pocket located in the left pole mechanical module.

6. The residential circuit breaker of claim 1, wherein the panel wire indicator lever includes a post to locate a compression spring such that the compression spring is configured to force the panel wire indicator lever to rotate in a clockwise direction when the panel wire is not installed in the lug body.

7. The residential circuit breaker of claim 6, wherein a first end of the compression spring rests against a solid stop feature located in a pole mechanical module such that the compression spring is captured in the pole mechanical module with a surrounding geometry on up to two sides, wherein the surrounding geometry in the pole mechanical module provides a guide as the compression spring is extended and compressed during the panel wire insertion and/or removal from the lug body.

8. The residential circuit breaker of claim 7, wherein at an opposite end a second end of the compression spring pushes against a panel wire indicator lever surface.

9. The residential circuit breaker of claim 6, wherein the panel wire indicator lever includes a colored surface that is used to indicate that the panel wire has been installed properly.

10. The residential circuit breaker of claim 9, wherein the panel wire indicator lever is configured to rotate clockwise by pushing the panel wire against a wire indicator lever surface such that as the panel wire indicator lever rotates clockwise and a lug body screw surface of the lug body screw is fully exposed to insert a tool for tightening a connection, wherein the compression spring compresses during this operation and the compression spring provides a force and a travel in an extended position to ensure that the colored surface overhangs a portion of the lug body screw surface when the panel wire is not installed.

11. A residential circuit breaker comprising:

a left pole mechanical module;

a right pole mechanical module;

a first circuit breaker lug having a first lug body and a first lug body screw; and a first panel wire install indicator to indicate proper insertion of a panel wire in the first lug body by providing a visual indication to an installer/contractor that the panel wire has been fully inserted in the first circuit breaker lug during and after installation, wherein the first panel wire install indicator including a first panel wire indicator lever wherein the first panel wire indicator lever is capable of indicating if the panel wire has been installed properly and wherein there is a visual indication if the panel wire is no longer present in the first lug body, and wherein the first panel wire install indicator further including a first compression spring that is located in the left pole mechanical module and a second panel wire install indicator further including a second compression spring that is located in the right pole mechanical module.

12. The residential circuit breaker of claim 11, further comprising:

a load lug assembly; and an electronic module, wherein the first compression spring and the second compression spring are located toward the load lug assembly.

13. The residential circuit breaker of claim 11, wherein the first panel wire indicator lever covers a portion of the first lug body screw located in the left pole mechanical module and wherein a second panel wire indicator lever covers a portion of a second lug body screw located in the right pole mechanical module.

14. The residential circuit breaker of claim 11, wherein the first panel wire indicator lever is made of either a thermoplastic glass filled Nylon 6/6 material or a mineral filled Phenolic material.

15. The residential circuit breaker of claim 11, wherein the first panel wire indicator lever includes a first post that pivots within a first pocket located in the left pole mechanical module and a second post that pivots within a second pocket located in the right pole mechanical module.

16. A method of providing an install indicator of a panel wire in a residential circuit breaker comprising:

providing a circuit breaker lug having a lug body and a lug body screw; and providing a panel wire install indicator to indicate proper insertion of the panel wire in the lug body by providing a visual indication to an installer/contractor that the panel wire has been fully inserted in the circuit breaker lug during and after installation, wherein the panel wire install indicator including a panel wire indicator lever wherein the panel wire indicator lever is capable of indicating if the panel wire has been installed properly and wherein there is a visual indication if the panel wire is no longer present in the lug body.

17. The method of claim 16, the method further comprising:

providing a load lug assembly;

providing a left pole mechanical module;

providing a right pole mechanical module; and providing an electronic module, wherein the panel wire install indicator further including a first compression spring that is located in the left pole mechanical module and a second compression spring that is located in the right pole mechanical module such that the first compression spring and the second compression spring are located toward the load lug assembly.

18. The method of claim 16, wherein the panel wire indicator lever covers a portion of the lug body screw located in the left pole mechanical module.

19. The method of claim 16, wherein the panel wire indicator lever is made of either a thermoplastic glass filled Nylon 6/6 material or a mineral filled Phenolic material.

20. The method of claim 16, wherein the panel wire indicator lever includes a first post that pivots within a first pocket located in the left pole mechanical module.

* * * * *